US009444163B2

(12) United States Patent
Vasapollo

(10) Patent No.: US 9,444,163 B2
(45) Date of Patent: Sep. 13, 2016

(54) MINIATURIZED WIRE-TO-BOARD CONNECTOR SYSTEM FOR WEARABLE DEVICES

(71) Applicant: Curzio Vasapollo, Tokyo (JP)

(72) Inventor: Curzio Vasapollo, Tokyo (JP)

( * ) Notice: Subject to any disclaimer, the term of this patent is extended or adjusted under 35 U.S.C. 154(b) by 0 days.

(21) Appl. No.: 14/492,064

(22) Filed: Sep. 21, 2014

(65) Prior Publication Data

US 2016/0087362 A1 Mar. 24, 2016

(51) Int. Cl.
*H01R 12/75* (2011.01)
*H01R 12/72* (2011.01)

(52) U.S. Cl.
CPC ..... *H01R 12/75* (2013.01); *H01R 12/728* (2013.01)

(58) Field of Classification Search
CPC .. H01R 12/72; H01R 12/721; H01R 12/722; H01R 12/724; H01R 12/725; H01R 12/727; H01R 12/728; H01R 12/75
See application file for complete search history.

(56) References Cited

U.S. PATENT DOCUMENTS 4,493,525 A * 1/1985 Hall ..... H01R 9/032 439/607.47
4,611,878 A * 9/1986 Hall ..... H01R 9/032 439/353
4,634,208 A * 1/1987 Hall ..... H01R 9/032 439/607.51
5,378,162 A * 1/1995 Waible ..... H01R 4/023 439/106
6,830,477 B2 * 12/2004 Vander Vorste ..... H01R 13/743 439/214
6,902,432 B2 * 6/2005 Morikawa et al. ..... 439/607.41
7,034,225 B2 * 4/2006 Thompson ..... H01K 1/62 174/66
7,112,097 B1 * 9/2006 Lam ..... H01R 25/003 439/654
8,029,318 B2 * 10/2011 Namiki ..... H01R 24/30 439/106
8,619,412 B2 * 12/2013 Ewing ..... H01R 24/30 340/531
2006/0234530 A1 * 10/2006 Chung ..... 439/79

* cited by examiner

*Primary Examiner* — Ross Gushi
(74) *Attorney, Agent, or Firm* — Russ Weinzimmer & Associates, PC

(57) ABSTRACT

A miniaturized wire-to-board connector system is disclosed for establishing electrical connection between an electrical cable and a printed circuit board, and for establishing mechanical connection between the electrical cable and a case having the printed circuit board enclosed therein. The connector system includes a male and a female connector, is small enough to be incorporated in a highly miniaturized wearable device, and is stable and sturdy enough to be handled directly by a consumer, thereby enabling an increase in complexity, providing interconnectable parts in wearable consumer products. The connector system is also useful in aerospace applications in which components must be connected within a very small space.

18 Claims, 6 Drawing Sheets

MINIATURIZED WIRE-TO-BOARD CONNECTOR SYSTEM FOR WEARABLE DEVICES

FIELD OF THE INVENTION

The present invention relates generally to electrical connectors, and more particularly to wire-to-board connectors.

BACKGROUND OF THE INVENTION

It has been estimated that the market for wearable devices in the sports and health sectors will grow to nearly 170 million devices by 2017—an annual growth rate of 41 percent. In wearable devices, size is critical for user comfort. However, there is a scarcity of suitably small interconnection elements, of the sort that may be used for a miniaturized external port, such as a headset, speaker, data or charging port, or to connect multiple body worn units together. Radio transmission can be used as wire replacement for data exchange, but it increases power consumption, leading to a need for larger batteries, especially when mesh networking protocols must be implemented (as is the case with Bluetooth), thus imposing a limit on miniaturization.

Many commercially available miniaturized connectors such as those sold by Molex, such as their wire-to-board micro miniature interconnects, are meant to be used inside electronic devices, and not as an outside interconnect. Their size makes them very fragile, and not suited to being handled directly by a consumer. Most of these types of connectors, for example the PicoBlade, have a structurally fragile wire-to-connector junction on the wire side. They will eventually fail by repeated use, or if the wire is pulled accidentally.

Developing a custom connector is a difficult and expensive process, because, given the sizes, there is no reliable way of predicting the "feel" and strength of a particular configuration, until expensive tooling is created and the design is tested. Finalizing a design requires multiple iterations and production of costly tooling. Designing for small sizes is also quite demanding as the artifacts introduced by manufacturing processes, such as excess material, constitute a significant fraction of the volume or area of the product. Due to complexity, costs and time involved, custom miniature connector design cannot normally be part of the R&D cycle of a new consumer product.

SUMMARY OF THE INVENTION

The connector system of the invention enables a cable to be connected to a miniaturized electronic device. The connector system is sufficiently small to be used in a highly miniaturized body worn (wearable) device, and is sufficiently stable and sturdy to be handled directly by a consumer, thus enabling creation of wearable consumer products having multiple interconnected parts. The connector system of the invention is also useful in aerospace applications wherein components must be interconnected within a very small space.

One general aspect of the invention is a connector system for establishing electrical connection between an electrical cable and a printed circuit board, and for establishing mechanical connection between the electrical cable and a case having the printed circuit board contained therein. The connector system includes a male connector having a non-conductive male body capable of being manually gripped; and a plurality of conductive pins supported by the non-conductive male body, each conductive pin being connectable to a wire of an electrical cable; a female connector having a non-conductive female body having a plurality of conductive receptacles, each conductive receptacle being capable of receiving a conductive pin, and being capable of removably capturing each conductive pin, the non-conductive female body being trappable within a wall of a case having the printed circuit board contained therein; and a plurality of conductors, each conductor extending from each respective conductive receptacle, each conductor capable of being soldered to a metallic pad of the printed circuit board.

In some embodiments, each conductive pin of the male connector is longer than the non-conductive female body of a respective conductive receptacle and extends beyond the non-conductive female body when the conductive pin is inserted into the respective conductive receptacle of the female connector. In further embodiments, each conductive pin of the male connector is at least 4 mm long.

In some embodiments, when the male connector is inserted into the female connector, the non-conductive male body of the male connector abuts the wall of the case.

In some embodiments, the non-conductive male body of the male connector has one or more auxiliary extrusions so as to prevent bending of the conductive pins during handing of the male connector.

In some embodiments, the non-conductive male body of the male connector is a plastic or rubber body encapsulating part of the conductive pins.

In some embodiments, the non-conductive female body of the female connector is affixed in abutting relationship with an edge of the circuit board.

In some embodiments, an outer surface of the non-conductive female body of the female connector is flush with the outer surface of the wall of the case.

In some embodiments, the printed circuit board is mechanically stabilized within the case by being trapped by other components contained entirely within the case.

In some embodiments, each conductive pin of the male connector is connected to a wire of the electrical cable via a solder joint.

Another general aspect of the invention is a connector system for establishing electrical connection between an electrical cable and a printed circuit board, and for establishing mechanical connection between the electrical cable and a case having the printed circuit board contained therein. This connector system includes: a male connector having: a non-conductive male body capable of being manually gripped; and a plurality of conductive pins supported by the non-conductive male body, the non-conductive male body being formed by over-molding so as to encapsulate a portion of each conductive pin, each conductive pin being connected to a wire of the electrical cable via a solder joint; a female connector having: a non-conductive female body having a plurality of conductive receptacles, each conductive receptacle being capable of receiving a conductive pin, and being capable of removably capturing each conductive pin, the non-conductive female body being trappable within a wall of a case having the printed circuit board contained therein; and a plurality of conductors, each conductor extending from each respective conductive receptacle, each conductor capable of being soldered to a metallic pad of the printed circuit board.

In some embodiments, each conductive pin of the male connector is longer than the non-conductive female body of a respective conductive receptacle and extends beyond the non-conductive female body when the conductive pin is inserted into the respective conductive receptacle of the female connector.

In some embodiments, each conductive pin of the male connector is at least 4 mm long.

In some embodiments, when the male connector is inserted into the female connector, the non-conductive male body of the male connector abuts the wall of the case.

In some embodiments, the non-conductive male body of the male connector has one or more auxiliary extrusions so as to prevent bending of the conductive pins during handing of the male connector.

In some embodiments, the non-conductive male body of the male connector is a plastic or rubber body encapsulating part of the conductive pins.

In some embodiments, the non-conductive female body of the female connector is affixed in abutting relationship with an edge of the circuit board.

In some embodiments, wherein an outer surface of the non-conductive female body of the female connector is flush with the outer surface of the wall of the case.

In some embodiments, the printed circuit board is mechanically stabilized within the case by being trapped by other components contained entirely within the case.

In some embodiments, a length each conductive receptacle of the non-conductive female body is at least 1.5 mm.

BRIEF DESCRIPTION OF THE DRAWINGS

The invention will be more fully understood by reference to the detailed description, in conjunction with the following figures, wherein.

DETAILED DESCRIPTION OF THE INVENTION

Figure 1:
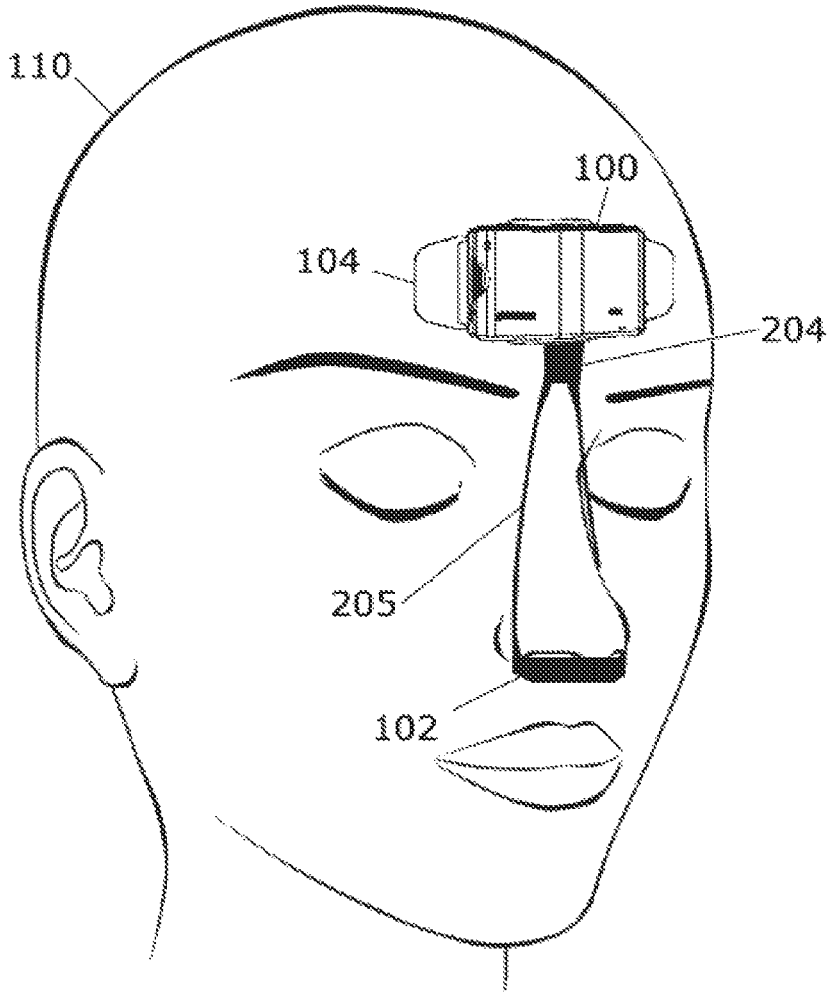
FIG. 1 is a line drawing of a person shown wearing a miniaturized wearable device to which an external sensor is connected by means of a wire.

With reference to FIG. 1, the present invention is best understood in the context of a highly miniaturized body-worn device 100 affixed to a person's 110 forehead by means of an adhesive electrode assembly 104 and meant to be worn during sleep. The body-worn device 100 has an optional, external breathing sensor 102. The breathing sensor 102 is optionally connected to the body-worn device 100 by the person 110. The electrical connection between the breathing sensor 102 and the body-worn device 100 is realized by one or more wires 205. The wires 205 extend from the sensor 102 to a non-conductive male connector body 204.

Figure 2A:
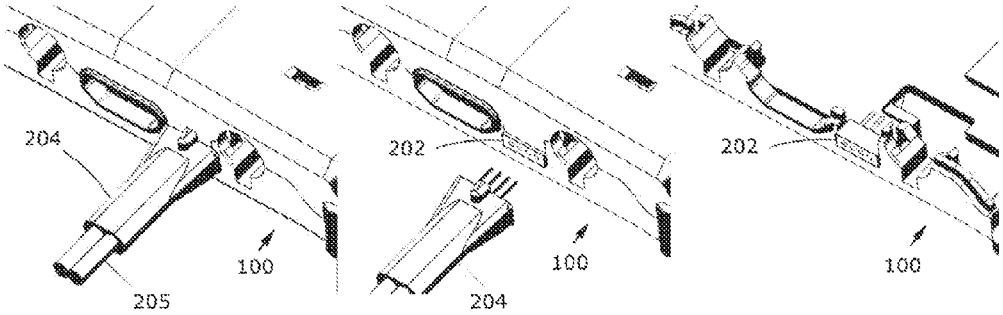
FIG. 2A includes three line drawings of a connector system, representing, left to right: the connector system in the mated state; the connector system in the unmated state; and the female portion of the connector system (female connector) within the wearable device.

FIG. 2A consists of three drawings. In the left drawing, the male connector is plugged into the body-worn device 100. In the middle drawing, the body-worn device 100 is shown near the unplugged male connector; a female connector 202 is also visible. In the right drawing, the body-worn device 100 has the top half of the case removed to reveal the inner portion of the female connector 202.

Figure 2B:
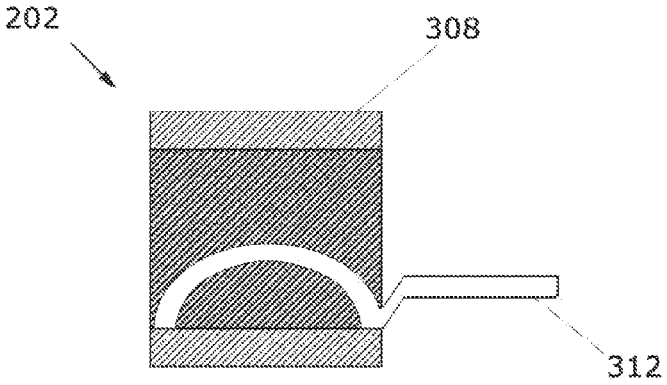
FIG. 2B is a schematic drawing of the internals of the female portion of the connector system.

FIG. 2B is a schematic drawing of a side cut-out view of the miniaturized female connector 202, the female connector 202 including a non-conductive female body 308 and one or more metallic conductors 312. A high level of miniaturization can be achieved when the metallic contacts have arranged with a pitch (distance) of 1.00 mm between any two neighboring contacts.

Figure 3A:
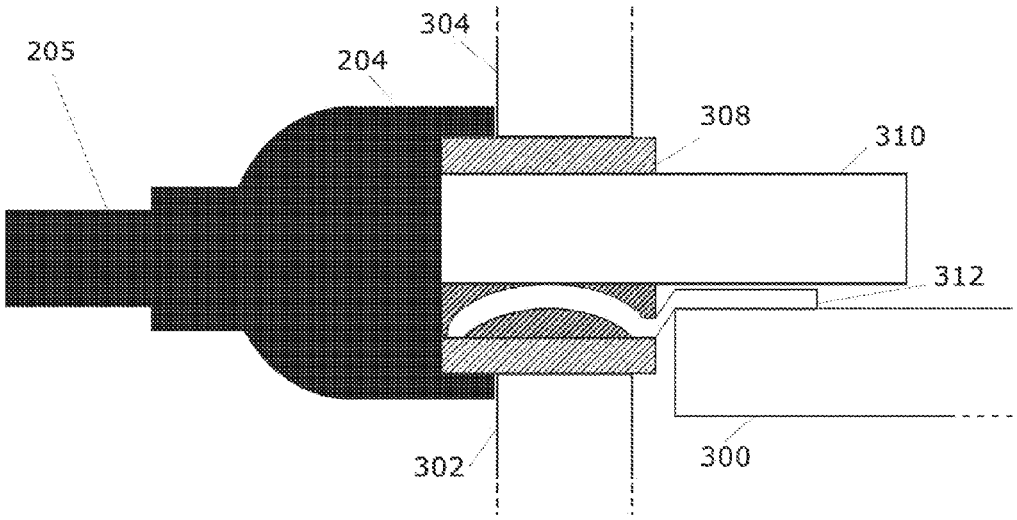
FIG. 3A is a schematic drawing of a side cut-out view of the connector system in the mated state.

FIG. 3A is a schematic drawing of a side cut-out view of the connector system in its mated state. The miniaturized female connector 202 is shown in FIG. 3A in its constituent components: a non-conductive female body 308 and metallic conductors 312. The female connector 202 is mounted on the circuit board 300 by soldering its metallic conductors 312 to matching pads on the circuit board. The non-conductive female body 308 is stabilized and held in place by the lower half of the case 302 and the upper half of the case 304. The support thus provided by the case prevents damage to the thin metallic conductors 312 when the connector is mated and unmated.

In FIG. 3A an external male connector (composed of a non-conductive male body 204, a wire 205 and a plurality of metallic pins 310) is plugged into the female connector 202. The metallic pins 310 can slide all the way through the non-conductive female body 308 of the female connector and for best results extend as far as the female connector 202's metallic conductors 312. This additional length stabilizes the interconnect preventing the male connector from falling off. Experiments with 1.00 mm pitch, 2.00 mm length metallic pins 310 (just long enough to fill the holes in the non-conductive female body 308 of the female connector) did not yield acceptable results as the male connector easily fell off. A length of 4.00 mm proved ideal and the connector was mated with sufficient stability for a wearable device.

Figure 3B:
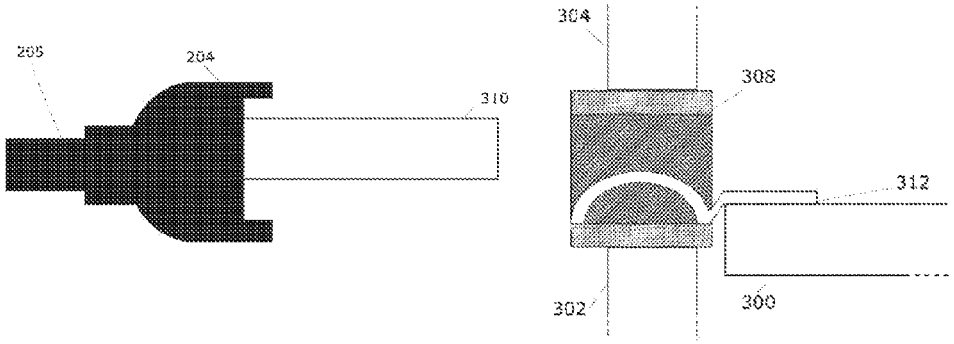
FIG. 3B is a schematic drawing of a side cut-out view of the connector system in the un-mated state.

FIG. 3B is a schematic drawing of a side cut-out view of the connector system of FIG. 3A, when the connector system is in the unmated state (the male connector has been unplugged).

Figure 4:
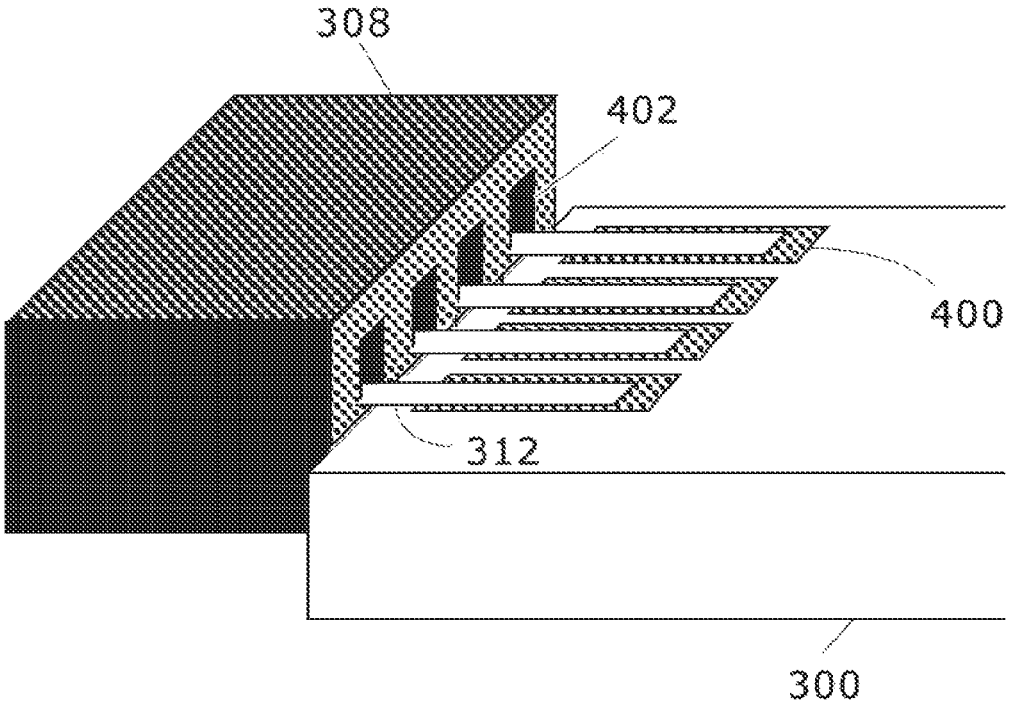
FIG. 4 is a schematic drawing of the female portion of the connector system mounted on a circuit board.

FIG. 4 is a more detailed schematic drawing of the female connector 202. Each female conductive receptacle 402 consists of a channel through the non-conductive female body 308 and a metallic conductors 312 that extends into the channel. Each female conductive receptacle 402 can accept a metallic pin of the male metallic pins 310. The metallic conductors 312 extend outwards from each channel in the non-conductive female body 308 and each metallic conductor is soldered to matching rectangular pad 400 on a circuit board 300. The geometry shown is typical of a female connector having 1.00 mm pitch, 2.00 mm body 308 height, and 2.00 mm metallic conductors 312 length (the length is measured from the opening of the female receptacles 402).

Figure 5:
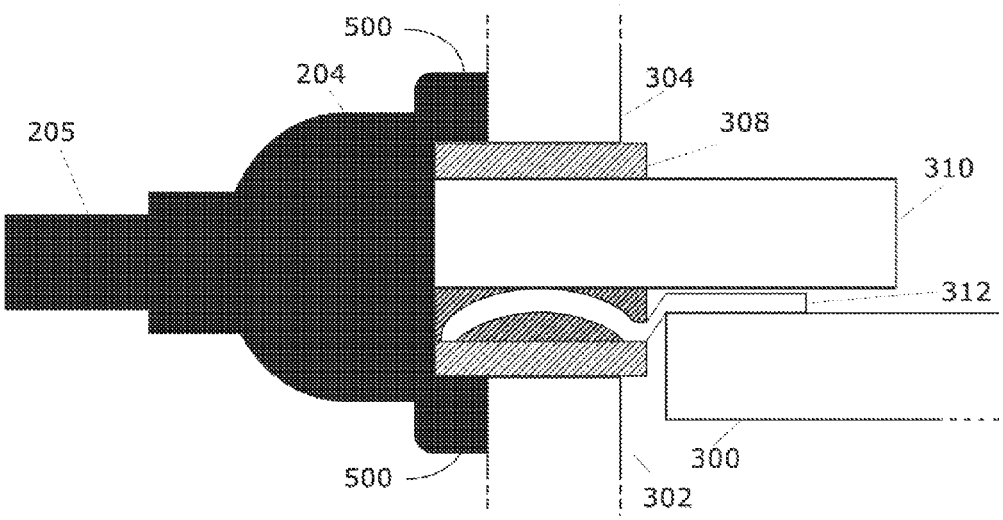
FIG. 5 is a schematic drawing of a side cut-out view of a variant of the connector system in the mated state, the variant having increased stability.

FIG. 5 is a schematic drawing of an alternate embodiment of the connector system. In this embodiment, an auxiliary extrusion 500 is added to the non-conductive male connector body 204, so as to prevent rotation of the connector along the axis perpendicular to the plane of view. In this fashion, bending of the male connector's pins 310 when the person 110 plugs and unplugs the connector is prevented.

Figure 6:
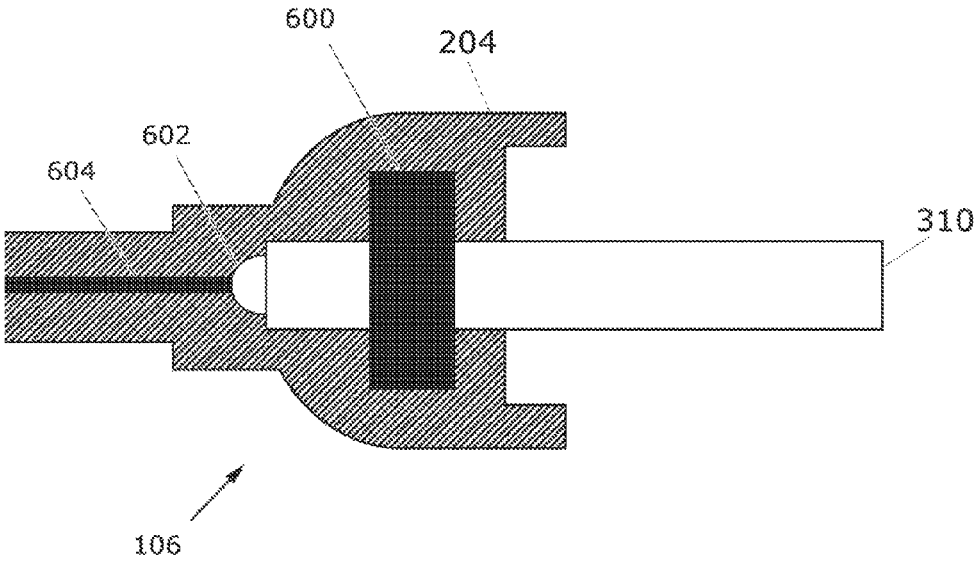
FIG. 6 is a schematic drawing of a side cut-out view of the male portion of the connector system (male connector), in which the internals of the male connector are visible.

With reference to FIG. 6, a possible method of manufacturing the male connector is to use a readily available male pin header which includes metallic pins 310 and a plastic support 600. Wire cores 604 are hand soldered to one side of the metallic pins 310, so as to connect the wire cores 604 to the metallic pins 310 with tiny solder joints 602. Then, the non-conductive male body 204 is added by molding. To minimize the size of the connector, it is useful to use an asymmetrical pin header, in which the plastic support 600 is not centered. Possibly, the left side of the metallic pins 310 is 1 mm long, which is sufficient for careful soldering, and the right side is 7 mm long, enough to penetrate the non-conductive female body 308 of the female connector 202 and reach beyond it for stability, as explained above.

Figure 7:
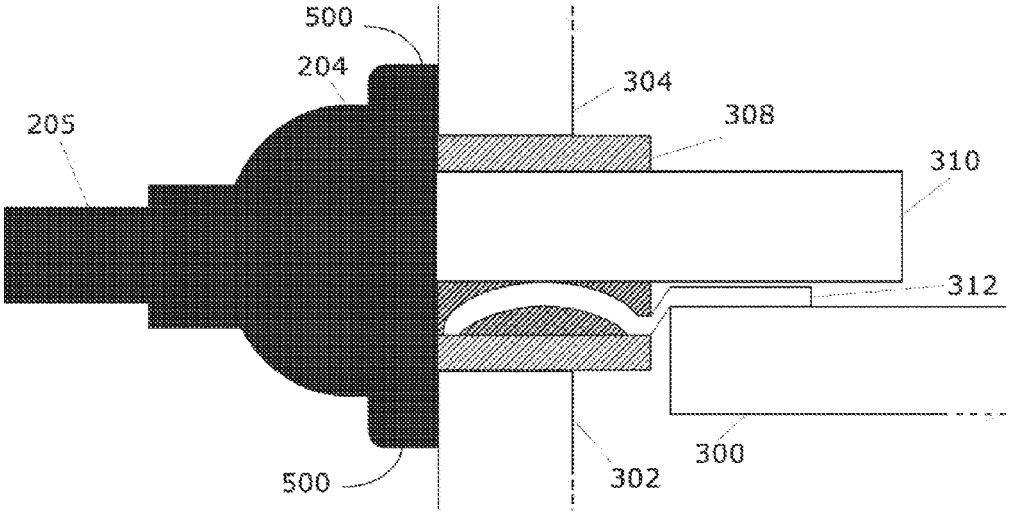
FIG. 7 is a schematic drawing of a side cut-out view of a variant of the connector system in the mated state, the variant having increased ruggedness.

FIG. 7 is a schematic drawing of a side cut-out view of a variant of the connector system of FIGS. 3A and 3B when the connector system is in the mated state, this variant having an outer surface of the non-conductive female body 308 flush with the outer surfaces of the bottom half 302 and top half 304 of the case. In this variant, the non-conductive female body 308 of the female connector 202 is not only trapped between the bottom half 302 and top half 304 of the case, but it is also made impervious to outside forces. Because the consumer cannot apply force to the non-conductive female body 308, the durability and ruggedness of the wearable device is improved.

Other modifications and implementations will occur to those skilled in the art without departing from the spirit and the scope of the invention as claimed. Accordingly, the above description is not intended to limit the invention except as indicated in the following claims.

What is claimed is:

1. A connector system for establishing electrical connection between an electrical cable and a printed circuit board, and for establishing mechanical connection between the electrical cable and a case having the printed circuit board contained therein, the connector system comprising:

a female connector including:

a non-conductive female body having a plurality of conductive receptacles, each conductive receptacle having a conductor extending therefrom, each conductive receptacle being capable of receiving a conductive pin, and being capable of removably capturing each conductive pin, the non-conductive female body being trappable within a wall of a case having the printed circuit board contained therein, and each conductor capable of being soldered to a metallic pad of the printed circuit board, and a male connector including:

a non-conductive male body capable of being manually gripped; and a plurality of conductive pins supported by the non-conductive male body, each conductive pin being connectable to a wire of an electrical cable, and each conductive pin extending substantially beyond the male body, each conductive pin of the male connector being longer than the non-conductive female body of a respective conductive receptacle, and extending beyond the non-conductive female body when the conductive pin is inserted into the respective conductive receptacle of the female connector.

2. The connector system of claim 1, wherein each conductive pin of the male connector is at least 4 mm long.

3. The connector system of claim 1, wherein when the male connector is inserted into the female connector, the non-conductive male body of the male connector abuts the wall of the case.

4. The connector system of claim 1, wherein the non-conductive male body of the male connector has one or more auxiliary extrusions abutting the outer wall of the case so as to resist bending of the conductive pins while the male connector is engaged with the female connector, and the male connector is inadvertently laterally pushed.

5. The connector system of claim 1, wherein the non-conductive male body of the male connector is a plastic or rubber body encapsulating part of the conductive pins.

6. The connector system of claim 1, wherein the non-conductive female body of the female connector is affixed in abutting relationship with an edge of the circuit board.

7. The connector system of claim 1, wherein an outer surface of the non-conductive female body of the female connector is flush with the outer surface of the wall of the case.

8. The connector system of claim 1, wherein the printed circuit board is mechanically stabilized within the case by being trapped by other components contained entirely within the case.

9. The connector system of claim 1, wherein each conductive pin of the male connector is connected to a wire of the electrical cable via a solder joint.

10. A connector system for establishing electrical connection between an electrical cable and a printed circuit board, and for establishing mechanical connection between the electrical cable and a case having the printed circuit board contained therein, the connector system comprising:

a female connector including:

a non-conductive female body having a plurality of conductive receptacles, each conductive receptacle having a conductor extending therefrom, each conductive receptacle being capable of receiving a conductive pin, and being capable of removably capturing each conductive pin, the non-conductive female body being trappable within a wall of a case having the printed circuit board contained therein; and each conductor capable of being soldered to a metallic pad of the printed circuit board; and a male connector including:

a non-conductive male body capable of being manually gripped; and a plurality of conductive pins supported by the non-conductive male body, the non-conductive male body being formed by over-molding so as to encapsulate a portion of each conductive pin, each conductive pin being connected to a wire of the electrical cable via a solder joint, each conductive pin extending substantially beyond the male body, each conductive pin of the male connector being longer than the non-conductive female body of a respective conductive receptacle, and extending beyond the non-conductive female body when the conductive pin is inserted into the respective conductive receptacle of the female connector.

11. The connector system of claim 10, wherein each conductive pin of the male connector is at least 4 mm long.

12. The connector system of claim 10, wherein when the male connector is inserted into the female connector, the non-conductive male body of the male connector abuts the wall of the case.

13. The connector system of claim 10, wherein the non-conductive male body of the male connector has one or more auxiliary extrusions abutting the outer wall of the case so as to resist bending of the conductive pins while the male connector is engaged with the female connector, and the male connector is inadvertently laterally pushed.

14. The connector system of claim 10, wherein the non-conductive male body of the male connector is a plastic or rubber body encapsulating part of the conductive pins.

15. The connector system of claim 10, wherein the non-conductive female body of the female connector is affixed in abutting relationship with an edge of the circuit board.

16. The connector system of claim 10, wherein an outer surface of the non-conductive female body of the female connector is flush with the outer surface of the wall of the case.

17. The connector system of claim 10, wherein the printed circuit board is mechanically stabilized within the case by being trapped by other components contained entirely within the case.

18. The connector system of claim 10, wherein a length each conductive receptacle of the non-conductive female body is at least 1.5 mm.

* * * * *